US005881457A

United States Patent [19]

Liu

[11] Patent Number: 5,881,457

[45] Date of Patent: Mar. 16, 1999

[54] METHOD OF MAKING REFRIGERANT TUBES FOR HEAT EXCHANGERS

[75] Inventor: Qun Liu, Grosse Ile, Mich.

[73] Assignee: Ford Motor Company, Dearborn, Mich.

[21] Appl. No.: 865,588

[22] Filed: May 29, 1997

[51] Int. Cl.[6] ..... B23P 15/26

[52] U.S. Cl. ..... 29/890.053; 29/890.054; 29/890.045

[58] Field of Search ..... 29/890.053, 890.054, 29/890.045, 890.049; 165/183, 177

[56] References Cited

U.S. PATENT DOCUMENTS

| | | |
|---|---|---|
| 3,158,181 | 11/1964 | Gore . |
| 3,650,005 | 3/1972 | Kamiya et al. . |
| 4,805,693 | 2/1989 | Flessate . |
| 4,900,328 | 2/1990 | Breda et al. . |
| 5,172,476 | 12/1992 | Joshi . |
| 5,185,925 | 2/1993 | Ryan et al. . |
| 5,186,250 | 2/1993 | Ouchi et al. . |
| 5,271,151 | 12/1993 | Wallis . |
| 5,318,114 | 6/1994 | Sasaki . |
| 5,381,600 | 1/1995 | Patel . |
| 5,386,629 | 2/1995 | Ouchi et al. . |
| 5,412,869 | 5/1995 | Boltz et al. . |
| 5,441,105 | 8/1995 | Brummett et al. . |
| 5,441,106 | 8/1995 | Yukitake . |
| 5,456,006 | 10/1995 | Study . |
| 5,476,141 | 12/1995 | Tanaka . |
| 5,553,377 | 9/1996 | Hirano et al. . |
| 5,560,425 | 10/1996 | Sugawara et al. . |
| 5,579,837 | 12/1996 | Yu et al. . |

FOREIGN PATENT DOCUMENTS

| | | |
|---|---|---|
| 5-177286(A) | 7/1993 | Japan . |

*Primary Examiner*—Irene Cuda
*Attorney, Agent, or Firm*—Raymond L. Coppiellie

[57] ABSTRACT

A method for forming a heat exchanger tube is disclosed. The method includes the steps of forming a pair of identical, asymmetric upper and lower members which and joining them together to form a tube. A plurality of longitudinally extending walls are also formed in the tube members. The walls form a plurality of flow paths in each tube.

16 Claims, 3 Drawing Sheets

METHOD OF MAKING REFRIGERANT TUBES FOR HEAT EXCHANGERS

BACKGROUND OF THE INVENTION

1. Field of the Invention

The present invention relates generally to methods for making refrigerant tubes for heat exchangers. More particularly, the present invention relates to a method for making a refrigerant tube for a heat exchanger wherein the tube is formed from identical members having asymmetric sides.

2. Disclosure Information

Heat exchangers employ a wide variety of tube geometries depending upon the heat transfer characteristics needed to be achieved. For example, U.S. Pat. No. 5,381,600 discloses a condenser for an automotive vehicle using round tubes having an internal surface with corrugation-like teeth formed thereon. Other heat exchanger designs use different types of tubes. A second example can be found in air conditioning system condensers of the parallel flow type. In this type of condenser, substantially flat refrigerant tubes are used. These tubes must withstand high pressure gaseous refrigerant which flows through them and still achieve high heat transfer characteristics. As is well known, these flat tubes have a plurality of discrete flow paths formed therein. The flow paths can be formed by inserting an undulating metal insert into the tube and brazing the insert into place. The flow paths can also be formed by forming walls in the tube during an extrusion process.

U.S. Pat. No. 5,553,377 teaches a method for making refrigerant tubes for use in condensers. The tubes in the '377 patent are formed from two members, a bottom member having a plurality of walls along the longitudinal length of the tube and a top member which acts as a "lid" or cover. The top member is brazed to the bottom member to form the tube. However, during fabrication of this type of tube, the top member must be held securely in place to prevent it from sliding relative to the bottom member. The top and bottom members of the tube are substantially different in shape, requiring further labor and expense in fabricating this tube. It would be advantageous to achieve the beneficial effects of a generally flat tube formed by joining two members together without incurring the substantial labor and cost associated with multiple designs.

It is an object of the present invention to provide a method for making a refrigerant tube which is less expensive to manufacture by employing identical tube members joined together to form the tube.

It is a further object of the present invention to provide a tube which is formed from two members which lock together during the fabrication process to prevent relative movement between the members during brazing.

SUMMARY OF THE INVENTION

The present invention overcomes the problems associated with the prior art by providing a method for making a refrigerant tube for a heat exchanger comprising the steps of providing blanks of aluminum material and cladding the blanks of aluminum material with a coating of cladding material of a substantially constant thickness. A pair of identical tube members are then formed from the cladded blanks, each one of the tube members having interior and exterior surfaces with a generally planar base and a pair of asymmetric, elongated side edges. A first side edge of the tube member has a substantially constant cross-section, while the second side edge of the tube member has a tapering cross-section. The method further includes applying a flux material to the internal surfaces of the tube members and interlocking the elongated side edges of the tube members to form a tube. The ends of the first side edge of the tube are then rolled over the exterior surfaces of the tube and the tube is brazed at a predetermined temperature for a predetermined time.

The method further includes the steps of forming a plurality of interior elongate walls extending longitudinally along the length of each of the tube members. Each one of the plurality of walls extends generally perpendicularly from the plane of the base of each tube member a predetermined distance. The method also includes forming a detent wall in each one of the tube members spaced apart from the first side edge a predetermined distance such that the detent wall tapers from a greater width at the tube member base to a lesser width at a distance spaced from the tube member base. The detent wall locks the first side edge of one of the tube members into the mating tube member to prevent the tube members from moving during the remaining fabrication process.

It is an advantage of the present invention that identical tube members may be utilized to form a tube, thus saving substantial costs in tooling, labor and materials used to form the tubes.

These and other objects, features, and advantages of the resent invention will become apparent from the drawings, detailed description and claims which follow.

DETAILED DESCRIPTION OF THE PREFERRED EMBODIMENTS

Figure 1:
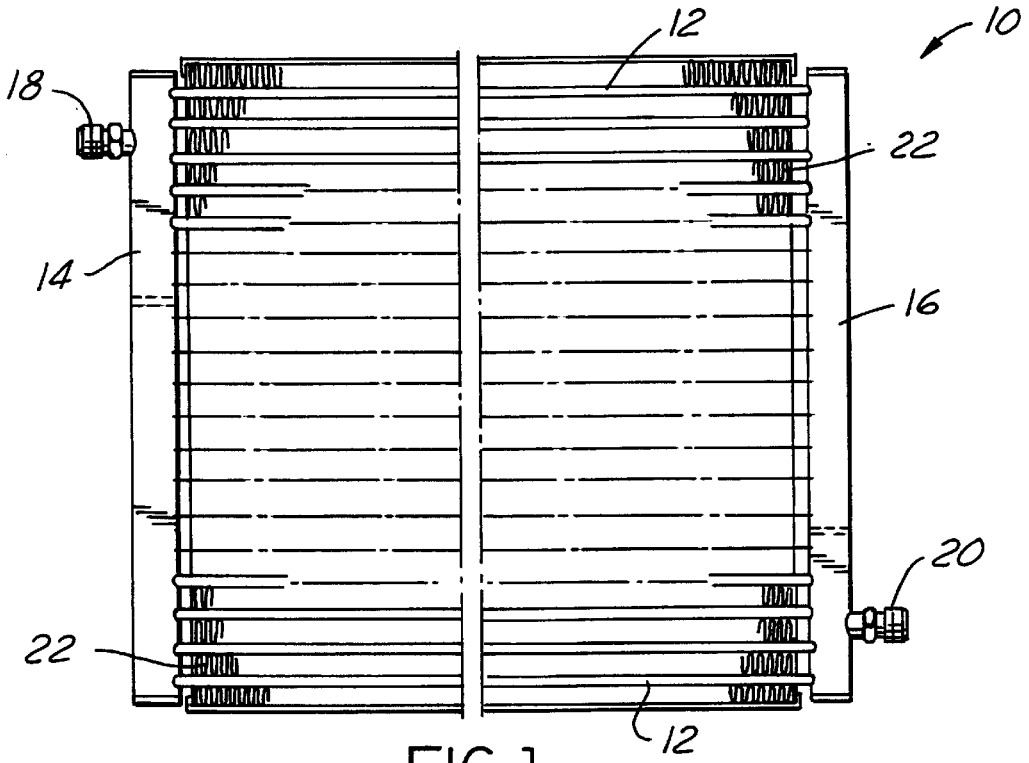
FIG. 1 is a perspective view of a heat exchanger for an automotive vehicle utilizing a heat exchanger tube of the present invention.

Referring now to the drawings, FIG. 1 shows a heat exchanger 10 for use in an automotive applications, such as a radiator or a condenser. The heat exchanger 10 includes a set of generally parallel tubes 12 extending between oppositely disposed headers 14, 16. A fluid inlet 18 for conducting cooling fluid into the heat exchanger 10 is formed in the header 14 and an outlet 20 is formed in header 16 for directing fluid out of the heat exchanger. Convoluted or serpentine fins 22 are attached to the exterior of the tubes 12 and serve as a means for conducting heat away from the tubes 12 while providing additional surface area for convective heat transfer by air flowing over the heat exchanger 10. The fins are disposed between each of the tubes 12 of the heat exchanger 10. Although the present invention will be hereinafter described with reference to a condenser used in automotive applications, the present invention is not meant to be limited to such application and can be used equally as well for other types of heat exchangers in non-automotive applications.

Figure 2:
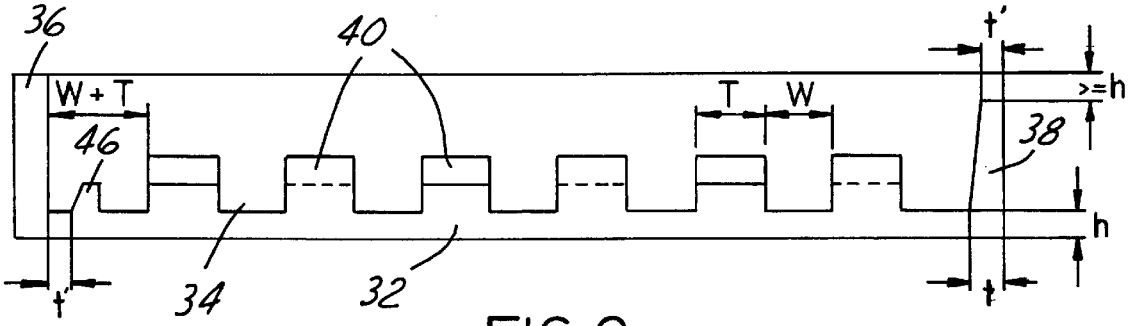
FIG. 2 is a cross-sectional view of one-half of a first embodiment tube structured in accord with the principles of the present invention.
Figure 3:
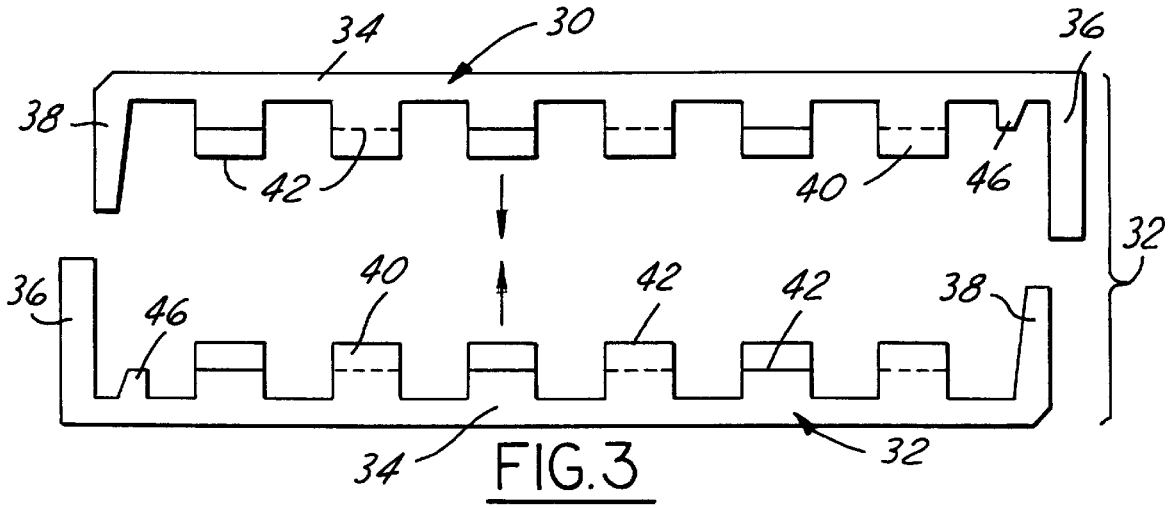
FIG. 3 is a cross-sectional view of one embodiment of a heat exchanger tube structured in accord with the principles of the present invention prior to the tube assembly.
Figure 4:
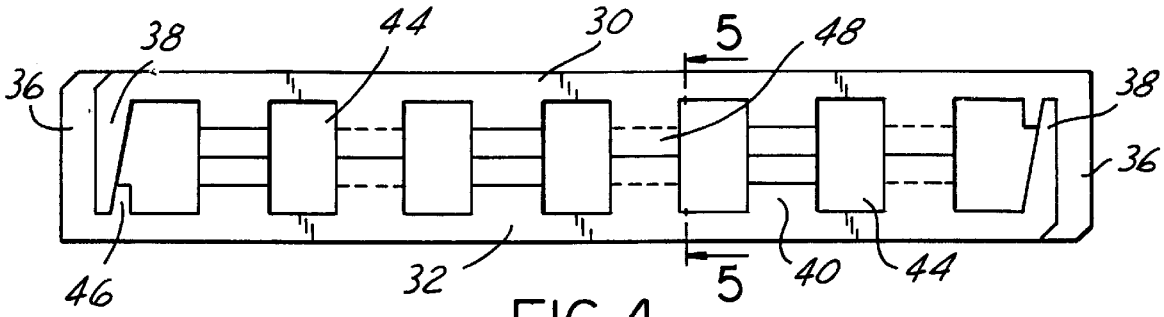
FIG. 4 is a cross-sectional view of the heat exchanger tube of FIG. 3 structured in accord with the principles of the present invention after the tube has been assembled.

FIGS. 2–4 show one embodiment of a heat exchanger tube 12 constructed according to the present invention. The tube 12 is a two piece assembly, having an upper tube member 30 and a lower tube member 32 joined together in opposed, mirrored relationship. Because each of the tube members 30, 32 are identical, mirror images of one another, only one will be described. It should be noted that the upper tube member 30 and lower tube member 32 are manufactured in a roll forming process and have identical features. Each of the upper 30 and lower 32 tube members includes a generally planar base 34 and a pair of asymmetric elongated side edges 36, 38 extending along the entire longitudinal length thereof. The side edges 36, 38 are asymmetric in that one edge 36 has a substantially rectangular, constant cross-section while the second side edge 38 has a tapering cross-section. The cross-section of edge 38 tapers from a greater thickness, t, near the base of the member to a lesser thickness, t', at a predetermined distance from the base. The height of the second side edge 38 is also less than the height of the first side edge 36 by an amount, h, equal to or less than the thickness of the base 34. The importance of the side edge 38 with the tapering cross-section will become apparent below. The corners of the side edges 36, 38 can also be rounded to ease in the fabrication process.

Each of the tube members 30, 32 further includes a plurality of longitudinally extending, elongated walls 40 projecting from the base 34 of the tube members. The walls 40 project from the base 34 of the tube member a predetermined distance. This distance is one of the differences between the tube embodiment shown in FIGS. 2–5 and that shown in FIGS. 7–10. Each will be described in detail.

The walls 40 shown in the tube 12 of FIGS. 2–5 project from the base by a distance approximately equal to one-half the overall height of the tube 12. These walls 40 are also disposed on the base and spaced apart from one another by an amount, W, such that when the upper tube member 30 is inverted and placed matingly over the bottom tube member 32 as shown in FIG. 4, the top surfaces 42 of the walls 40 contact each other to define a plurality of flow paths 44. Because the walls 40 contact opposing walls, the height of the walls 40 must be one-half of the tube height or the tube would not close.

Figure 7:
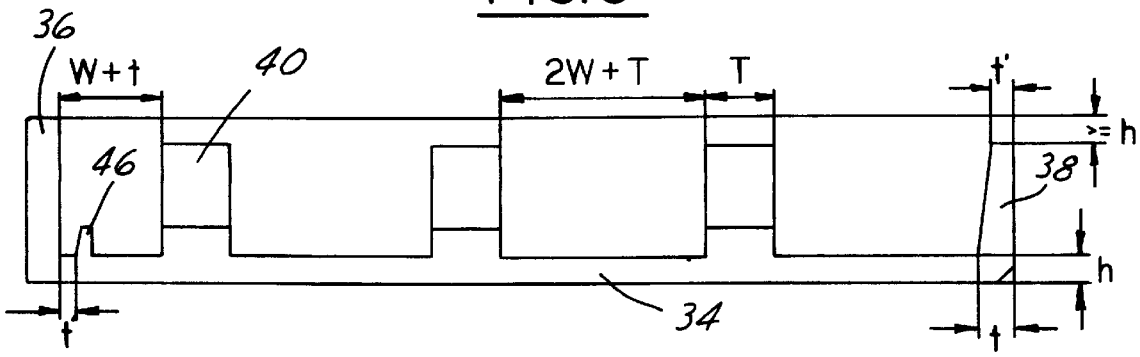
FIG. 7 is a cross-sectional view of one-half of a second embodiment tube structured in accord with the principles of the present invention.
Figure 8:
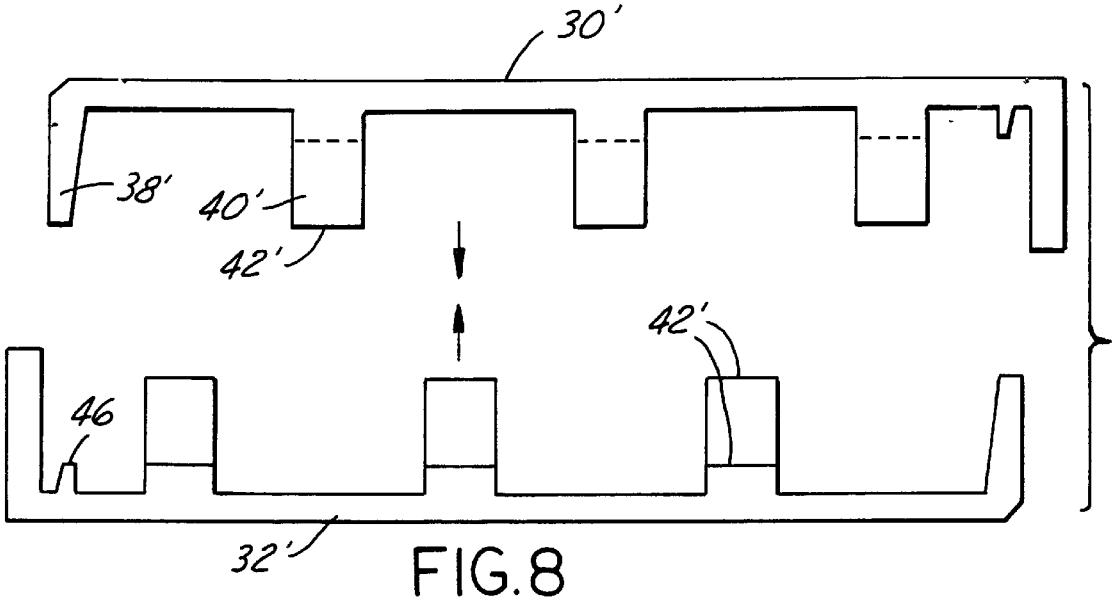
FIG. 8 is a cross-sectional view of a second embodiment of a heat exchanger tube structured in accord with the principles of the present invention prior to the tube assembly.
Figure 9:
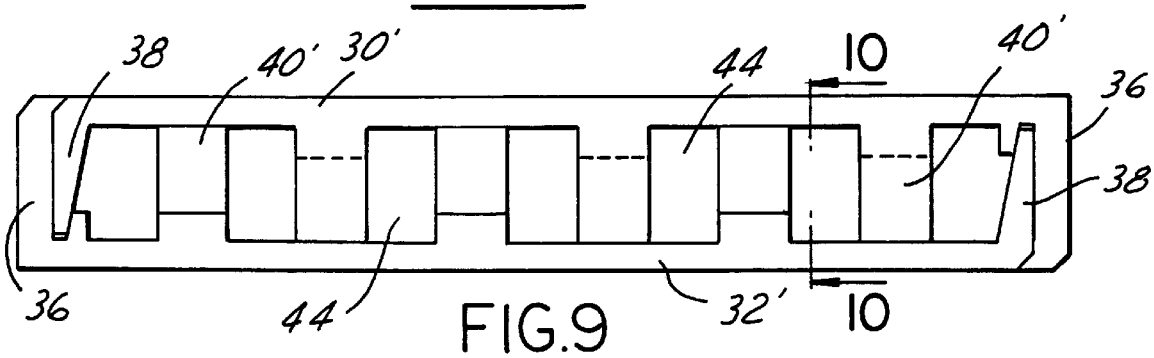
FIG. 9 is a cross-sectional view of the heat exchanger tube of FIG. 8 structured in accord with the principles of the present invention after the tube has been assembled.
Figure 10A:
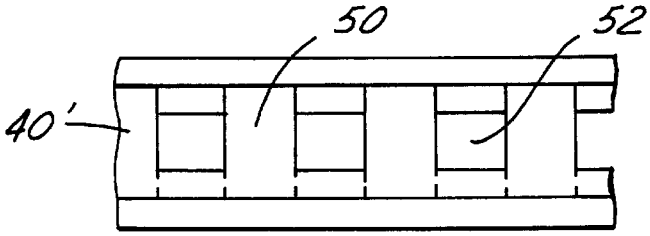
FIGS. 10A and B are cross-sectional views of the tube of FIG. 9, taken along line 10—10 of that Figure.
Figure 10B:
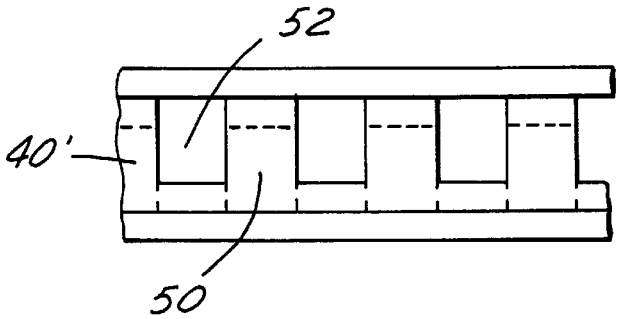

In the tube embodiment shown in FIGS. 7–9, the walls 40' project from the base 34' by a distance approximately equal to the overall tube height. These walls 40' are disposed on the base of the upper 30' and lower 32' tube members such that the walls 40' are offset to one another. When the upper tube member 30' is inverted and placed matingly over the bottom tube member 32' as shown in FIG. 7, the top surfaces 42' of the walls 40' contact the base 34' of the opposing tube member to define a plurality of flow paths 44'.

The tube members 30, 32 (as well as 30', 32') also include a detent wall 46. The detent wall 46 can be a wall extending along the entire longitudinal length of the tube or simply a step or series of interrupted steps. The detent wall 46 is spaced apart from the first side edge 36 by a distance t' and is disposed at an angle relative to this edge 36. The detent wall 46 also tapers from a greater width at the base of the tube member to a lesser width a predetermined distance therefrom. As can be seen in FIGS. 4 and 9, when the upper 30 and lower 32 tube members are inverted and matingly joined together, the detent wall 46 secures the second side edge 38, 38' (of tapering cross-section) of one of the tube members (upper or lower) in an interference fit into the space between the detent wall 46 and the first side edge 36, 36' of the opposed tube member. This interference fit prevents the tube members from becoming separated during the remaining fabrication process which will be described in greater detail below.

Figure 5A:
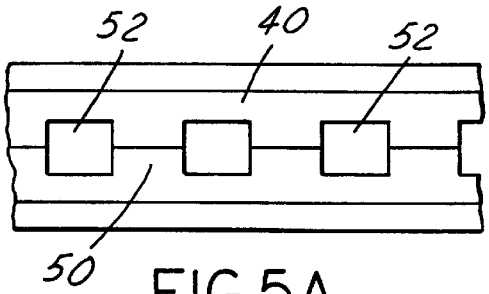
FIGS. 5A and B are cross-sectional views of the tube of FIG. 4, taken along line 5—5 of that figure.
Figure 5B:
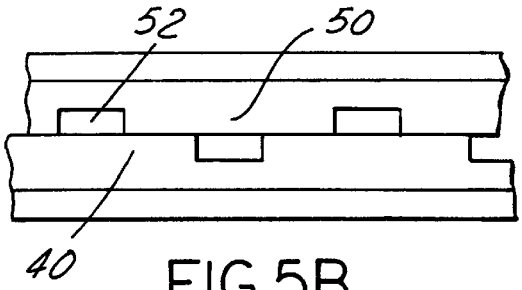

The walls 40, 40' may be formed in a roll forming process as a continuous, elongate wall extending the entire length of the tube. Alternatively, as shown in FIGS. 5A and B and 10 A and B, the walls 40, 40' may include stepped portions 50 of varying heights. These stepped portions 50 form windows which provide for a non-discrete flow path between adjacent flow paths 44 in each of the two tube embodiments. In FIGS. 5A and B, the stepped portions 50 form windows 52 when aligned or windows 54 when misaligned relative to one another when the upper 30 and lower 32 tube members are secured together. The stepped portions 50' of FIGS. 9A and B form similar windows 52', 54'. The size of the windows is critical to the heat transfer characteristic of the tube 12.

A method for making heat exchanger tubes 12 according to the present invention will now be described. The first step in the method is to provide blanks of aluminum material from which to fabricate the tubes and clad the blanks with a coating of any of a plurality of known cladding materials, such as an aluminum-silicon cladding material, of a substantially constant thickness. Preferably, both sides of the blanks are coated with the cladding material. After the blanks are cladded, a pair of identical tube members are formed by roll forming the cladded blanks. The blanks are formed into the upper (or lower) tube members 30, 32, each one having interior and exterior surfaces with a generally planar base and a pair of asymmetric, elongated side edges. As explained above, a first side edge 36 of the tube member has a substantially constant cross-section while the second side edge 38 has a tapering cross-section.

During this forming step, a plurality of interior elongate walls 40 extending longitudinally along the length of each of the tube members is also formed. The walls 40 extend generally perpendicularly from the plane of the base of each tube member a predetermined distance. As explained above, this distance is either one-half the overall tube height or approximately equal to the tube height. Stepped portions of varying height may also be formed in the longitudinally extending walls 40 at this point in fabrication. The stepped portions cooperate to form windows between flow paths as explained above. A detent wall 46 is also roll formed in each one of the tube members, spaced apart from the first side edge 36 a predetermined distance. The detent wall 46 is formed such that the detent wall tapers from a greater width at the tube base to a lesser width at a distance spaced therefrom.

Figure 6:
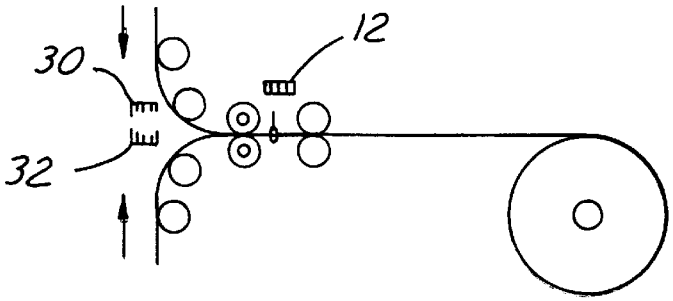
FIG. 6 is a schematic representation of a manufacturing system for fabricating the heat exchanger tube of the present invention.

After forming the tube members 30, 32, a flux material is applied to the internal surfaces of the members and the members are inverted and placed one over the other in opposed, mirrored relationship and rolled together as shown in FIG. 6. This causes the side edges to interlock between the first side edge 36 and the detent wall 46 to form a tube. The end 56 of the first side edge 36 is then rolled over the exterior surfaces of the tube, such as in a coining operation. The tube can then be brazed at a predetermined temperature for a predetermined time to cause the upper and lower members to join together to form a completed tube. More typically, however, the assembled (not brazed) tube is assembled into a heat exchanger assembly and the entire assembly is brazed to form a unit. This prevents the tube from passing through a brazing operation twice.

Many other variations and modifications will no doubt occur to those skilled in the art. It is the following claims, including all equivalents, which define the scope of the invention.

What is claimed is:

1. A method for making a refrigerant tube for a heat exchanger, comprising the steps of:

providing blanks of aluminum material;

cladding the blanks of aluminum material with a coating of a cladding material of a substantially constant thickness;

forming a pair of identical tube members from the cladded blanks, each one of the tube members having interior and exterior surfaces with a generally planar base and a pair of asymmetric, elongated side edges, a first side edge of the tube member having a substantially constant cross-section, a second side edge of the tube member having a tapering cross-section;

forming a plurality of interior elongate walls extending longitudinally along the entire length of each of the tube members, each one of the plurality of walls extending generally perpendicularly from the plane of the base of each tube member a predetermined distance;

forming a plurality of stepped sections into each longitudinally extending wall so as to provide fluid communication through said walls;

applying a flux material to the internal surfaces of the tube members;

interlocking the elongated side edges of the tube members to form a tube having a plurality of non-discrete flow paths defined by said longitudinally extending walls;

rolling the ends of the constant cross-section side edge over the exterior surfaces of the tube;

brazing the tube at a predetermined temperature for a predetermined time.

2. The method according to claim 1, wherein the predetermined distance is equal to the tube height after the tube members are joined together.

3. The method according to claim 2, wherein the longitudinally extending walls are formed offset of each other such that each wall contacts the base of the opposing tube member to form a plurality of fluid flow paths thereby when the tube members are joined together.

4. The method according to claim 1, wherein the predetermined distance is one-half of the tube height after the tube members are joined together.

5. The method according to claim 4, wherein the longitudinally extending walls are formed in opposing relationship with each other such that each wall contacts an opposing wall of the opposing tube member to form a plurality of fluid flow paths thereby when the tube members are joined together.

6. The method according to claim 5, wherein the step of forming the longitudinally extending walls further includes the step of forming a plurality of windows of predetermined configuration into each longitudinally extending wall, such that fluid flows nondiscretely therethrough from one flow path to an adjacent flow path when the tube members are joined together.

7. The method according to claim 1, wherein the step of forming a pair of identical tube members further includes the step of forming a detent in each one of the tube members spaced apart from the first side edge a predetermined distance for receiving the second side edge thereinto.

8. The method according to claim 7, wherein the step of forming the detent includes the steps of forming a longitudinally extending detent wall spaced apart from the first edge of the tube members by a distance less than the cross-sectional width of the second side edge so as to form an interference fit when the second side edge is placed between the detent wall and the first side edge.

9. The method according to claim 8, further including the step of forming the detent wall such that the detent wall tapers from a greater width at the tube member base to a lesser width at a distance spaced from the tube member base.

10. A method for making a refrigerant tube for a heat exchanger, comprising the steps of:

providing blanks of aluminum material;

cladding the blanks of aluminum material with a coating of cladding material of a substantially constant thickness;

forming a pair of identical tube members from the cladded blanks, each one of the tube members having interior and exterior surfaces with a generally planar base and a pair of asymmetric, elongated side edges, a first side edge of the tube member having a substantially constant cross-section, the second side edge of the tube member having a tapering cross-section, said forming step further including the steps of:

forming a plurality of interior elongate walls extending longitudinally along the entire length of each of the tube members, each one of the plurality of walls extending generally perpendicularly from the plane of the base of each tube member a predetermined distance;

forming a plurality of stepped sections into each longitudinally extending wall so as to provide fluid communication through said walls; and forming a detent wall in each one of the tube members spaced apart from the first side edge a predetermined distance such that the detent wall tapers from a greater width at the tube member base to a lesser width at a distance spaced from the tube member base;

applying a flux material to the internal surfaces of the tube members;

interlocking the elongated side edges of the tube members to form a tube;

rolling the ends of the constant cross-section side edge over the exterior surfaces of the tube;

brazing the tube at a predetermined temperature for a predetermined time.

11. The method according to claim 10, wherein the predetermined distance is equal to the tube height after the tube members are joined together.

12. The method according to claim 11, wherein the longitudinally extending walls are formed offset of each other such that each wall contacts the base of the opposing tube member to form a plurality of fluid flow paths thereby when the tube members are joined together.

13. The method according to claim 12, wherein the step of forming the longitudinally extending walls further includes the step of forming a plurality of stepped sections into each longitudinally extending wall, such that fluid flows nondiscretely therethrough from one flow path to an adjacent flow path when the tube members are joined together.

14. The method according to claim 10, wherein the predetermined distance is one-half of the tube height after the tube members are joined together.

15. The method according to claim 14, wherein the longitudinally extending walls are formed in opposing relationship with each other such that each wall contacts an opposing wall of the opposing tube member to form a plurality of fluid flow paths thereby when the tube members are joined together.

16. The method according to claim 15, wherein the step of forming the longitudinally extending walls further includes the step of forming a plurality of windows of predetermined configuration into each longitudinally extending wall, such that fluid flows nondiscretely therethrough from one flow path to an adjacent flow path when the tube members are joined together.

* * * * *